United States Patent [19]

Weingarten

[11] Patent Number: 4,658,852

[45] Date of Patent: Apr. 21, 1987

[54] BACKFLOW PREVENTER APPARATUS FOR FLUID FLOW LINES

[76] Inventor: Zvi Weingarten, Bermad, Kibbutz Evron, 25235, Israel

[21] Appl. No.: 789,449

[22] Filed: Oct. 21, 1985

[51] Int. Cl.[4] ..... F16K 24/02

[52] U.S. Cl. ..... 137/218

[58] Field of Search ..... 137/102, 218

[56] References Cited

U.S. PATENT DOCUMENTS 3,171,423 3/1965 Dillon ..... 137/218

3,952,766 4/1976 Johnson ..... 137/218

FOREIGN PATENT DOCUMENTS 2414893 10/1975 Fed. Rep. of Germany ..... 137/218

*Primary Examiner*—Robert G. Nilson

*Attorney, Agent, or Firm*—Silverman, Cass, Singer & Winburn, Ltd.

[57] ABSTRACT

Backflow preventer apparatus for preventing backflow of fluid in a fluid flow line includes an improved relief valve which drains fluid backflow from a zone between upstream and downstream check valves if the normal flow is shut off and downstream check valve fails to seal drip tight. During normal flow, the relief valve is closed. The relief valve includes a "peel seal" formed by a flexible diaphragm which peels to open the relief valve orifice for backflow therethrough from the downstream check valve to the ambient atmosphere.

21 Claims, 11 Drawing Figures

FIG. 4
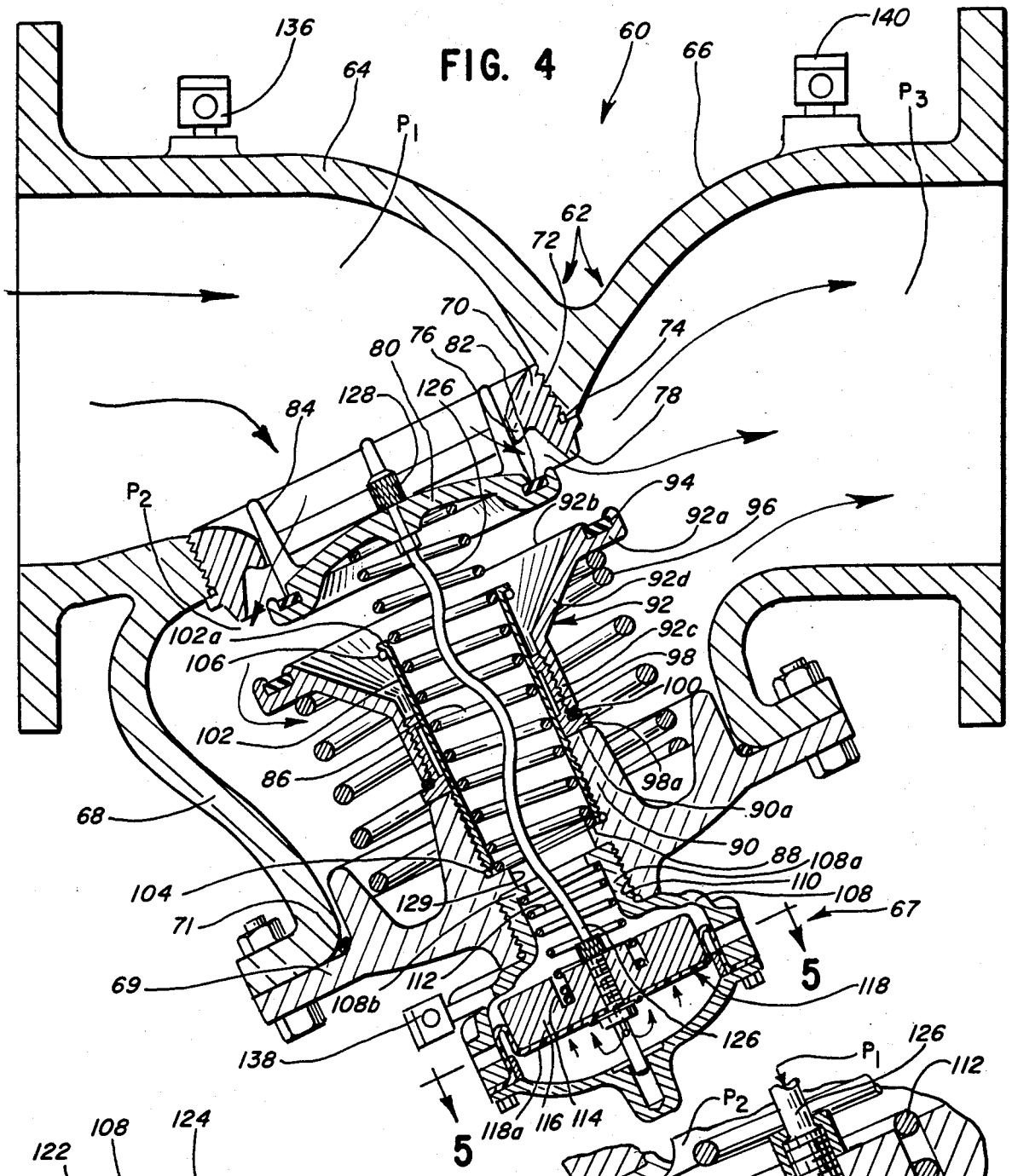
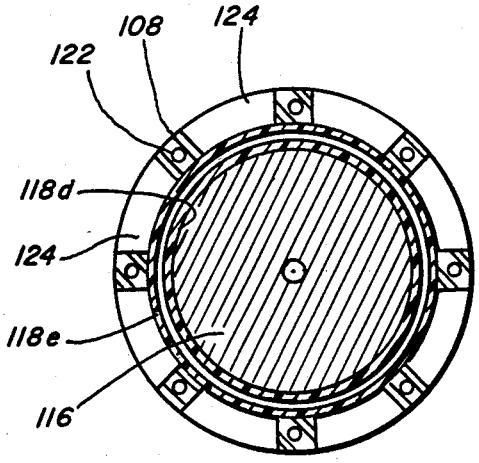
FIG. 5
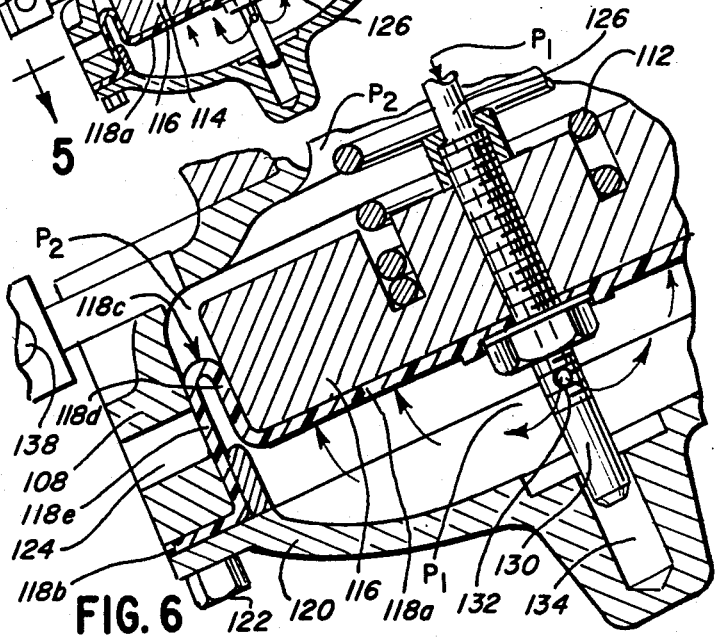
FIG. 6

FIG. 7
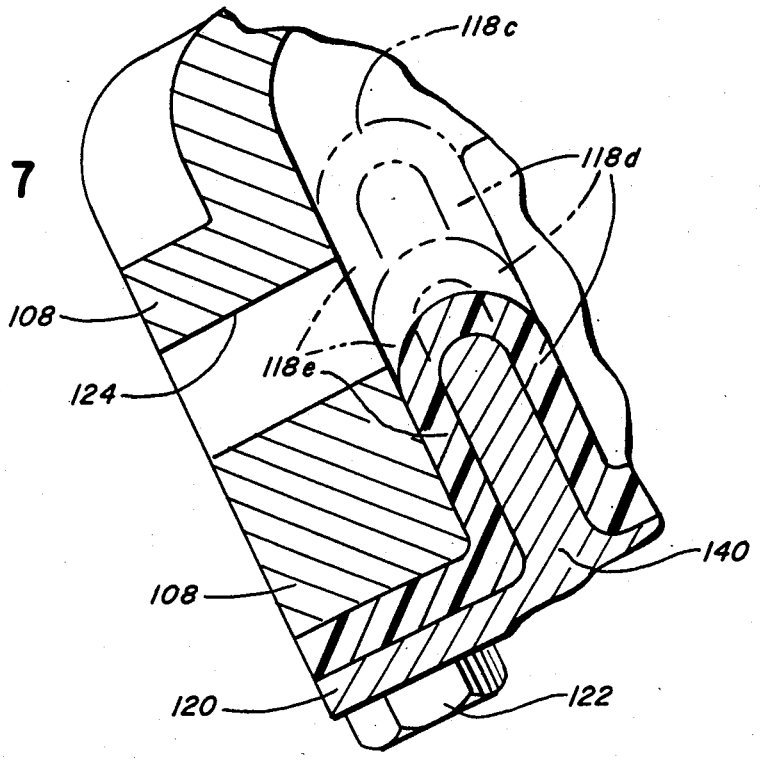
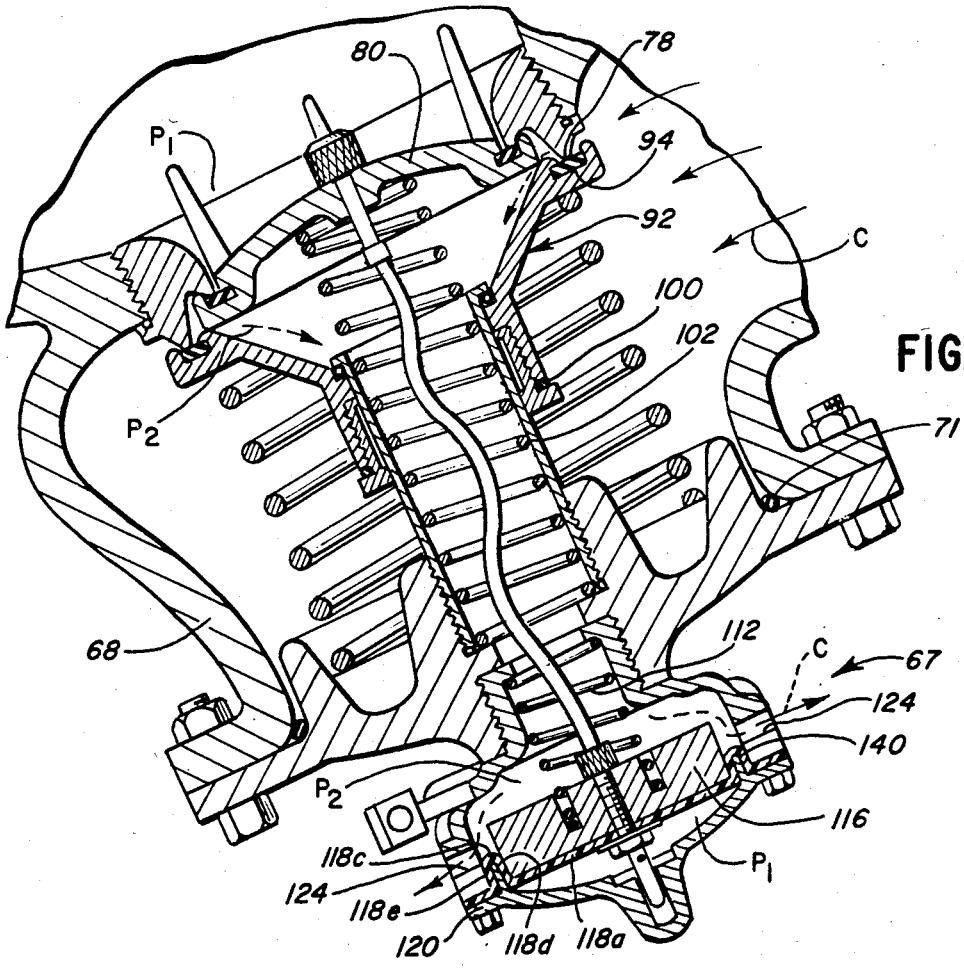
FIG. 8

BACKFLOW PREVENTER APPARATUS FOR FLUID FLOW LINES

BACKGROUND OF THE INVENTION

This invention relates to backflow preventer devices for fluid flow lines, and more particularly to improvements in relief valves of such devices.

Backflow preventer devices are conventionally installed in residential water distribution systems to prevent backflow of waste water. The backflow preventer devices are designated to discharge backflow to the atmosphere in order to prevent polluting the upstream water supply. Such backflow preventer devices typically include an upstream check valve and a downstream check valve. Between the two check valves an intermediate or reduced pressure zone provides for drainage to the atmosphere through a relief valve if the second check valve fails to seal when the upstream supply pressure is suddenly reduced or the main flow is entirely is shut off. U.S. Pat. Nos. 4,276,897, 3,171,423, RE 21,323 and 2,174,743 describe backflow preventer devices and relief valves. Serious problems experienced with many relief valves are the tendency for such valves to freeze closed and excessive friction in the relief action, particulary in water distribution systems. These disadvantages are eliminated in the backflow preventer device according to this invention.

SUMMARY OF THE INVENTION

A backflow preventer apparatus includes an improved relief valve for backflow drainage of the zone between upstream and downstream check valves. The relief valve has a flexible diaphragm which closes relief drainage orifices during normal fluid flow through the open check valves. If the normal flow is shut off and the downstream check valve fails to seal drip tight, the orifice-sealing portion of the diaphragm peels across and away from the orifices to enable fluid backflow therethrough from the downstream check valve to the atmosphere.

The diaphragm responds to the differential between the pressure upstream and downstream of the upstream check valve, and the peeling, relief action of the sealing portion of the diaphragm which exposes the drainage orifices is friction-free and independent of the absolute value of the total pressure exerted at the orifice. In preferred embodiments of the backflow preventer apparatus, the sealing and peeling portion of the relief valve diaphragm is defined by one arm of a U-shaped portion of the diaphragm which responds to the differential pressure. The diaphragm can have a circular or annular configuration.

BRIEF DESCRIPTION OF THE DRAWING

FIG. 4 is a medial sectional view in a vertical direction through a second embodiment of the backflow preventer apparatus of the invention;

FIG. 5 is a sectional view taken along the line 5-5 in FIG. 4 and in the indicated direction, illustrating the radial arrangement of drainage openings of the relief valve assembly;

FIG. 6 is an enlarged sectional view of the relief valve assembly shown in FIG. 4, partially broken away, illustrating the closed condition of the relief valve;

FIG. 7 is an enlarged sectional view of the relief valve of FIG. 8, partially broken away, illustratihg the peeling action of the relief valve diaphragm in opening of the relief valve; and FIG. 8 is a sectional view similar to FIG. 4, illustrating backflow of fluid through the closed, but insufficiently sealed downstream check valve and through the open relief valve to the ambient atmosphere.

DESCRIPTION OF THE PREFERRED EMBODIMENT

Figure 1:
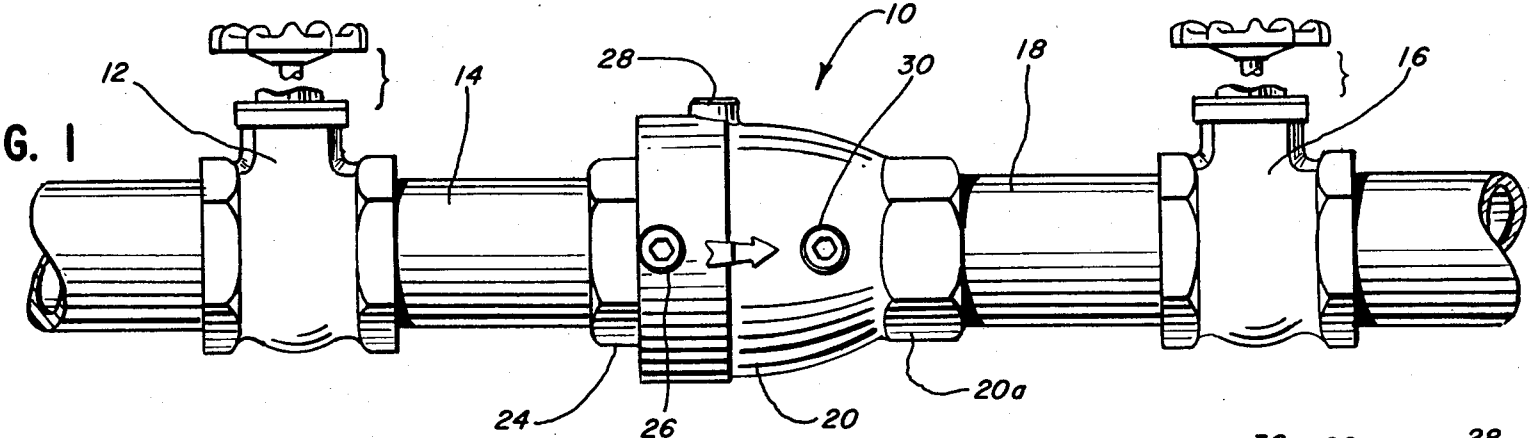
FIG. 1 is an elevation view illustrating a backflow preventer apparatus embodying the invention installed between supply and discharge pipes of a fluid flow line.
Figure 2:
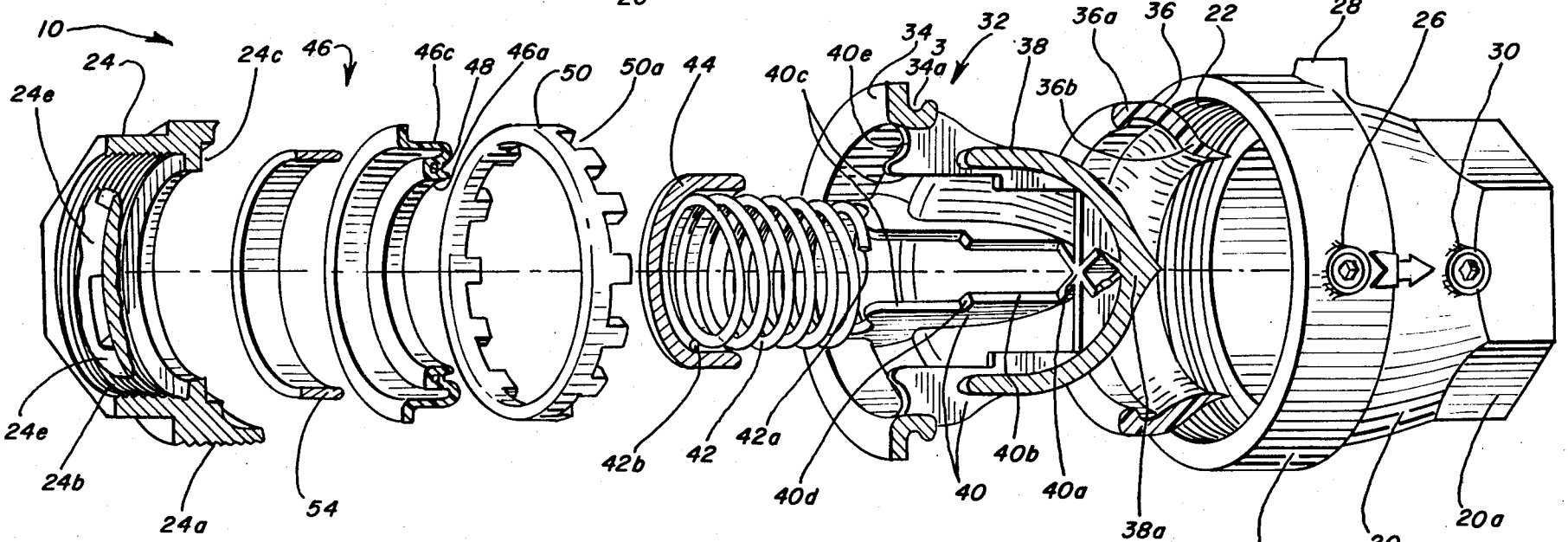
FIG. 2 is an exploded perspective view, partially in section, illustrating the components of the backflow preventer shown in FIG. 1.
Figure 3A:
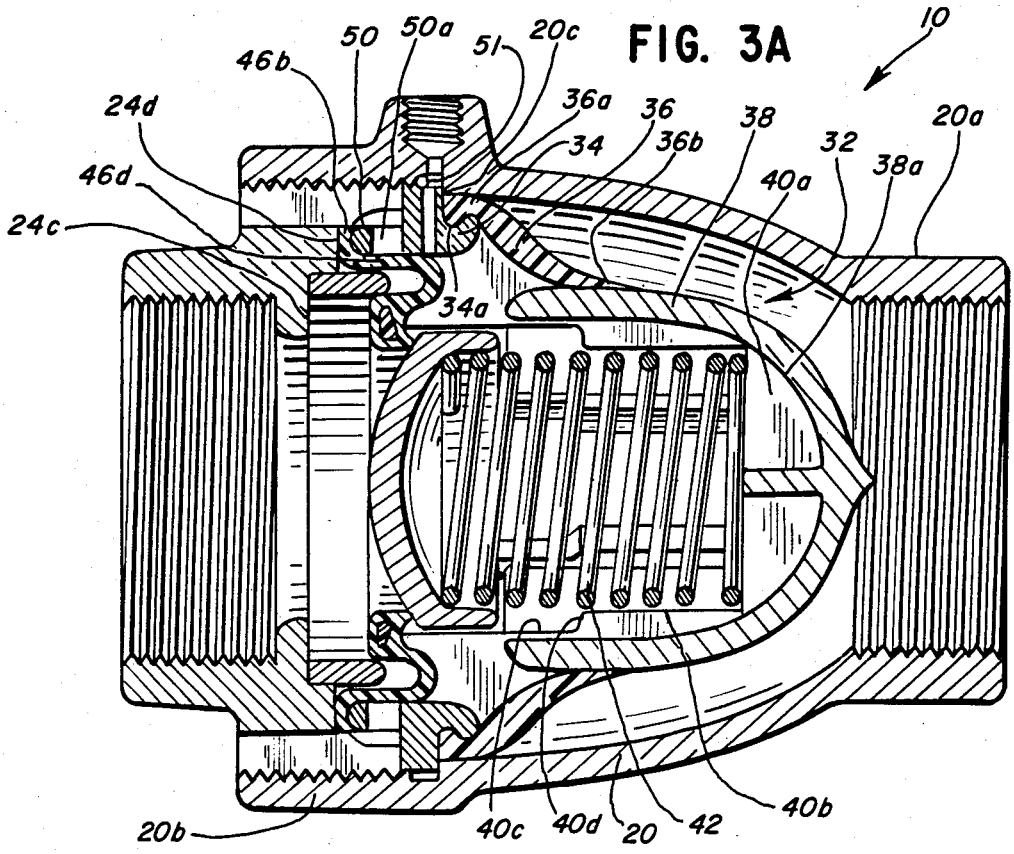
FIG. 3A is a medial sectional view taken through the backflow preventer of FIG. 1 in a vertical direction, illustrating the closed condition of three valves including an upstream check valve, a downstream check valve, and a relief valve.

Referring to FIG. 1, an embodiment of the backflow preventer is designated generally by reference character 10. The backflow preventer 10 is installed between a conventional gate valve 12 on the upstream, water-supply pipe 14 and a downstream gate valve 16 on the discharge pipe 18. The backflow preventer 10 includes a generally cylindrical valve housing 20, which has a discharge end **20*a* connected to the discharge pipe 18. As best shown in FIGS. 2 and 3A, the housing 20 has an inlet port 22 in the upstream end 20*b*. The backflow preventer 10 also includes a generally cylindrical inlet body 24 which has a downstream end 24*a* threaded into the inlet port 22 of the housing 20. The upstream supply pipe 14 is connected into the upstream end 24*b* of the body 24. The housing 20 and the body 24 are fabricated preferably from metal, for example, bronze. The housing 20 is provided with three conventional test fittings 26, 28 and 30, respectively, which are located at different longitudinal locations along the housing 20** to enable testing of pressure in different zones within the housing as more fully described hereinafter.

Referring again to FIGS. 2 and 3A, fitted within the housing 20 is a valve core generally designated by reference character 32. The core 32 includes an annular anchoring ring 34 which defines the upstream end of the core 32. The ring 34 includes an annular, outwardly exposed groove **34*a* which receives a bead 36*a* defining the upstream end of a resilient, annular valve flap 36. Alternatively, the bead 36*a* can be anchored within a groove formed in the inner surface of the housing 20, so that bead 36*a* can be clamped therein by a simple shoulder replacing the groove 34*a*. As best shown in FIG. 3A, the bead 36*a* is clamped between the ring 34 and the interior surface of the housing 20 while allowing the main body of the flap 36 to pivot about the bead 36*a*. The downstream annular end 36*b* of the flap 36 pivotally engages and disengages the outer surface of a generally dome-shaped hollow, inner core 38 which defines the downstream portion of the core 32. The engagement and disengagement of the flap end 36***b* with the inner core 38 defines the respective closing and opening of a downstream check valve which is shown in closed position in FIG. 3A and shown in open position in FIG. 3B, as more fully described hereinafter.

The ring 34 and the inner core 38 are joined by six rib members 40, four of which are shown in the longitudinal section of the core 32 in Fig. 2. The entire core 32 can be molded as a single unit from a plastic, for. example, nylon or polypropylene. The ribs 40 are generally equally spaced and extend radially inwardly from the ring 34 and the inner core 38. The ribs 40 intersect only at the extreme downstream ends 40*a* which join the inner surface of the closed end 38*a* of the inner core 38. The rib ends 40*a* provide a base on which the downstream, closed end 42*a* by the spring 42 is attached.

The upstream spring end 42*b* is seated against the interior surface of a dome-shaped disc 44. The disc 44 forms an upstream check valve member which is biased toward the upstream direction by the spring 42. The spring 42 is centered and guided by the interior surface of the rib portions 40*b* located directly upstream of rib ends 40*a*, as best shown in FIG. 3A. Each rib 40 also includes a retainer portion 40*c* which is longitudinally upstream and radially outward from the rib portion 40*b* which is joined at a shoulder 40*d*. The retainer portions 40*c* center and guide the reciprocal motion of the annular portion 44*a* of the disc 44. The shoulder 40*d* forms a stop against which the end of the annular portion 44*a* is engaged when the valve disc 44 is fully displaced by the pressure of the main flow thereon in the normally open condition of the upstream check valve as shown in FIG. 3B wherein the arrows A indicate the normal path of water flow.

Figure 3B:
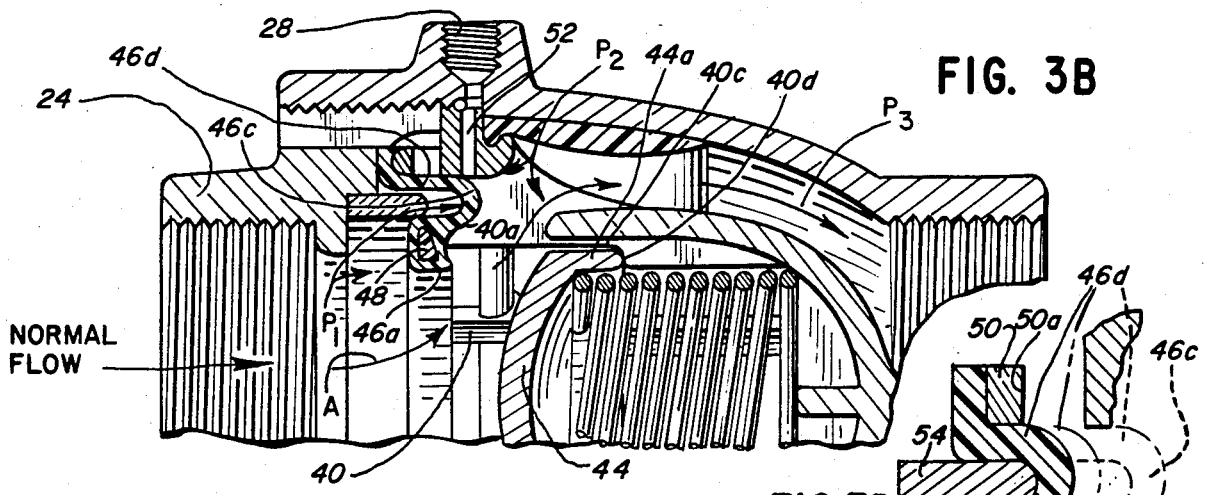
FIG. 3B is a sectional view similar to FIG. 3A, illustrating the normal flow condition through the open upstream and downstream check valves, and the closed relief valve.

In the normal flow condition shown in FIG. 3B, the water supply flowing from the inlet body 24 passes through the open, upstream check valve formed between the valve disc 44 and a relief valve diaphragm 46. The diaphragm is an annular, elastomeric member fabricated from flexible material, for example, polychloroprene The diaphragm 46 has an inner, circumferential ring 46*a* which defines the valve seat against which the valve disc 44 is engaged under the bias of spring 42, as shown in FIG. 3A, when upstream check valve is closed.

The circumferential ring 46*a* of the diaphragm 46 is thickened by wrapping or molding the inner periphery around an inserted ring 48 of metal or similar rigid material providing reinforcement of the ring 46*a*. As shown in both FIGS. 3A and 3C, the upstream surface of the ring 46*a* is seated against a stopper seat 24*c* formed as a radially inward projection on the body 24. The diaphragm ring 46*a* is seated by the upstream force of the engaged valve disc 44 under the bias of the spring 42 thus closing the upstream check valve as shown in both FIGS. 3A and 3C. The annular, outer periphery 46*b* of the diaphragm 46 is clamped between a downstream surface 24*d* of the body 24 and the upstream surface of a valve seat ring 50 as best shown in FIG. 3A.

Referring again to FIG. 2, the downstream portion of the ring 50 has a circumferentially spaced plurality of relief drainage openings 50*a* which pass radially between tongue members 50*b* as best shown in FIG. 2. The tongue members 50*b* engage the upstream surface of the ring 34 and clamp the ring against an annular shoulder 20*c* formed on the interior surface of the housing 20 thus anchoring the ring 34 and the core 32 therein, as shown in FIG. 3A. An O-ring 51 provides a circumferential seal between the ring 34 and the interior surface of the housing 20 upstream from the shoulder 20*c*.

Referring to FIG. 2, the diaphragm 46 has an annular medial portion 46*c* which has a generally horizontal, U-shaped cross section. As shown in FIGS. 3A and 3B the radially outer, annular arm 46*d* of the medial portion 46*c* covers and seals all of the openings 50*a*. This sealing is maintained under the normal flow conditions of FIG. 3B by the higher supply pressure $P_1$ on the upstream side of the U-shaped medial portion 46*c* in comparison to the lower pressure $P_2$ on the downstream side of the portion 46*c*. This differential pressure is created by the pressure drop across the upstream check valve due to the flow between the diaphragm ring 46*a* and the valve disc 44. The pressure indicated at $P_2$ is the flow pressure within the reduced pressure zone immediately downstream from the upstream check valve between ring 46*a* and disc 44. If, for example, the supply pressure $P_1$ (measured through the test fitting 26 in FIG. 1) is 100 PSI, the reduced pressure can be approximately 95 PSI under normal flow conditions, which creates a differential pressure on diaphragm portion 46*c* of, for example, approximately 5 PSI. This differential pressure urges the downstream displacement of the unanchored ring 46*a* and portion 46*c* which pulls the arm 46*d* across the openings 50*a*. The displacement of ring 46*a* and portion 46*c* is terminated by their engagement with the generally concave surface of the upstream stopping end portion 40*e* on each of the ribs 40. Therefore, as can be seen, the relief valve differential pressure (inlet to intermediate zone) responsive area remains constant throughout the relief valve action, from the full open position to and beyond the closing point of the drain openings 50 until stopped by concave portion 40*e*. The pressure $P_2$ exerted on the downstram surface of the diaphragm portion 46*c* is measured through the test fitting 28 which is extended through the ring 34 by a passageway 52.

The normal flow through the downstream check valve pivots the valve flap 36 outward and creates a pressure drop of, for example, approximately 2 PSI, so that the outlet pressure $P_3$ is approximately 93 PSI, as measured through fitting 30 (FIG. 1 and 2).

Figure 3D:
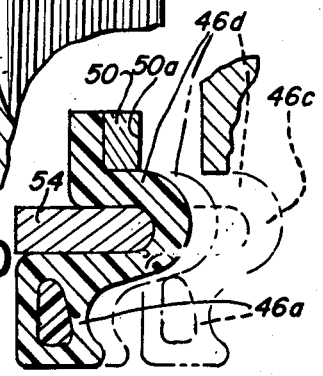
FIG. 3D is an enlarged sectional view, partially in phantom, of the relief valve of FIG. 3C illustrating the peeling action of the relief valve diaphragm in opening the valve.
Figure 3C:
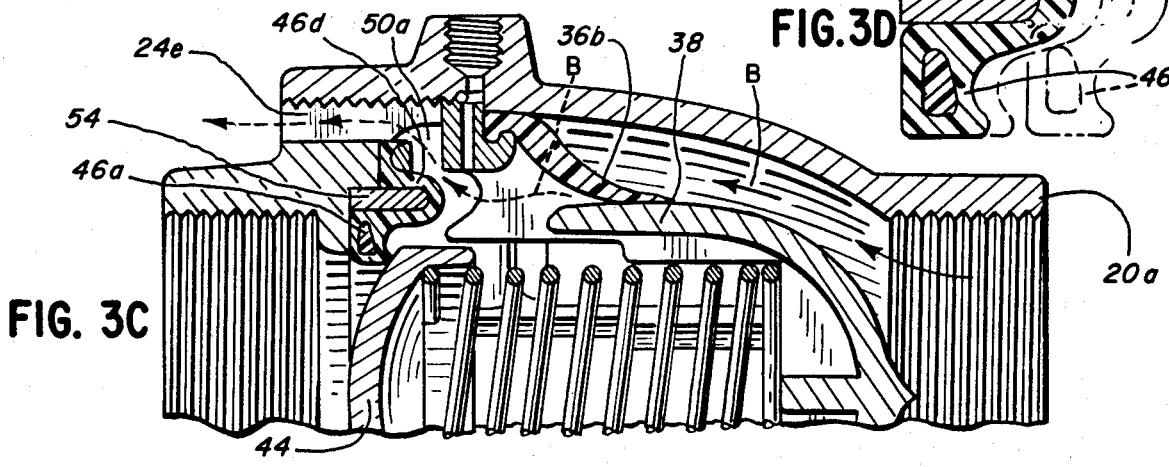
FIG. 3C is a sectional view similar to FIG. 3A, illustrating backflow of fluid through the closed but insufficiently sealed downstream check valve and through the open relief valve to the ambient atmosphere.

Referring to FIG. 3C, if the normal flow is shut-off and the valve flap end 36*b* fails to seal against the inner core 38 to shut the downstream check valve drip tight, the pressure $P_2$ will rise in comparison to the supply pressure $P_1$ creating a decrease in their differential pressure from 5 PSI to, for example, less than 3 PSI. This reduction in the differential pressure enables the spring 42 to displace upstream the valve disc 44 which engages the diaphragm ring 46*a* closing the upstream check valve. The disc 44 then pushes the ring 46*a* and portion 46*c* upstream. The upstream displacement of the portion 46*c* causes the arm 46*d* to peel at least partially across and away from the drainage openings 50*a* as shown in the progressive phantom positions of the diaphragm 46 in FIG. 3D. In other words, the U-shaped diaphragm portion 46*c* travels straight and axially in parallel to the rolling seal point or arm 46*d* which acts tangentially to the surface of drain opening 50*a*. Attached to the body shoulder 24*d* is a plastic stopper ring 54 which projects longitudinally downstream from the body 24 to guide the displacement of and prevent inversion of the U-shaped diaphragm portion 46c in case of upstream vaZjzHuum formation.

Referring again to FIG. 3C, the backward, upstream flow from the discharge end 20a indicated by arrows B passes outwardly through the exposed openings 50a. The backflow passes from the openings 50a through a circular pattern of spaced, arcuate slots 24e formed longitudinally through the periphery of the body end 24a, and the backflow discharges to the ambiZjzHnt.atmosphere from the slots 24e.

The diaphragm 46 responds to the differential between the pressure upstream and downstream of the upstream check valve, and the peeling, relief action of the diaphragm arm 46d which exposes the drainage openings 50a is friction-free and independent of the absolute value of the upstream pressure $P_1$exerted on the arm 46d over the openings 50a.

Referring to FIG. 4, a second embodiment of a backflow preventer of the invention is designated generally by reference character 60. The backflow preventer 60 includes a generally Y-shaped housing 62. The housing 62 includes an upstream section 64, a downstream section 66, and a lower section 68 with a main valve cover 69 to which a relief valve assembly 67 is connected. An O-ring 71 provides a seal between section 68 and valve cover 69. An annular valve seat member 70 is threaded into an opening 72 leading to the lower section 68 and the downstream section 66. An 0-ring 74 provides a seal between the member 70 and opening 72. The member 70 includes a first annular valve seat 76 and a second annular valve seat 78 which are formed as generally pointed concentric rings on the inner periphery of the member 70 and project downstream toward the lower section 68. The second seat 78 is somewhat larger in diameter and spaced downstream from the first seat 76. A first check valve disc 80 carries a resilient sealing ring 82 which is engageable with the first seat 76 to close an upstream check valve formed by the disc 80 and first seat 76. The disc 80 includes an annular guide ring 84 which projects from the upstream surface of the disc 80 The ring 84 is slideably fitted within the inner periphery of the member 70 adjacent the seat 76, and guides the reciprocal motion of the disc 80. The disc 80 can be fabricated from rigid plastic or similar material. The upstream end of a coil spring 86 is seated against the lower, downstream surface of the disc 80. The downstream end of the spring 86 is seated on an annular shoulder 88 formed inward of the bottom of a cylindrical collar 90 which projects concentrically from the interior surface of the main valve cover 69. The spring 86 biases the disc 80 upstream in opposition to the upstream supply pressure $P_1$ of the normal flow shown in FIG. 4. The spring 86 forces the disc 80 upstream engaging the seal 82 with the seat 76 closing the upstream check valve when flow is shut-off as shown in FIG. 8.

A funnel-shaped, second check valve disc generally designated 92 includes an annular flange 92a formed on the periphery of the mouth 92b. The flange 92a supports an annular check seal 94 which is engageable and dMzHMzHsengageable with the seat 78 to form a second, dowstream check valve. The upper end of a coil spring 96 is seated on the stationary, interior surface of the valve cover 69. The spring 96 biases the disc 92 in opposition to the pressure $P_2$ in the reduced pressure zone caused by the pressure drop of the flow through the first check valve between the seat 76 and seal 82 as shown in FIG. 4.

The valve disc 92 includes a lower cylindrical portion 92c which extends downward from the conical portion 92d. The interior surface of portion 92c is threaded to the exterior surface of a cylindrical sleeve bearing 98 which has an outwardly extending, annular flange 98a. An O-ring 100 provides a seal between the flange 98a and the lower end of the cylindrical section 92c. The sleeve bearing 98 is slideable on the exterior surface of the upper portion of a stationary draining cylinder 102. The lower portion of the cylinder 102 is threaded into the interior surface of the collar 90 and the lower end of cylinder 102 is seated on the shoulder 88 between the end of the spring 86 and an 0-ring 104 which provides a seal between the cylinder 102 and the collar 90. The upper portion of the cylinder 102 projects from the end 90a of the collar 90. The cylinder 102 provides support for sliding movement of the sleeve bearing 98 which carries the valve disc 92. The end 90a of the collar 90 provides a stop seat which engages the flange 98a to limit the downward displacement of the bearing 98 and disc 92. In addition the interior surface of the cylinder 102 provides a guide within which the spring 86 is limited in lateral movement. The upper end of the cylinder 102 has a small outward flange 102a, the lower surface of which seats an O-ring 106 which provides a seal between cylinder 102 and the conical portion 92d of the disc 92 when the disc 92 is displaced upwardly by the spring 96 to the closed position of the second check valve as shown in FIG. 8.

Referring again to FIG. 4, the relief valve assembly 67 includes a dome-shaped relief valve body 108 which has a nipple portion 108a threaded into a central passageway 110 formed in the valve cover 69. The upper end of the nipple portion 108a has an inward, annular flange 108b, the lower surface of which seats the upper end of a coil spring 112. The lower end of the spring 112 is seated against the blind bottom of an annular groove 114 formed through the upper surface of a diaphragm washer 116. The lower surface of the diaphragm washer 116 is attached to the central portion 118a of a generally circular, elastomeric, relief valve diaphragm 118. The diaphragm 118 is fabricated from, for example, polychloroprene or similar elastomer. The washer 116 can be fabricated from rigid plastic or similar material for supporting the diaphragm central portion 118a.

As best shown in FIG. 6, the annular periphery 118b of the diaphragm 118 is clamped between the valve body 108 and the valve cover 120 by means of bolts 122. The diaphragm 118 has an annular medial portion 118c which has a generally U-shaped cross section. The radially inner, annular arm 118d of the medial portion 118c is engaged with the annular, peripheral surface of the washer 116. The radially outer arm 118e of the medial portion 118c covers and seals the interior openings of eight relief drainage passageways 124 which open to ambient atmosphere radially through the relief valve body 108. The sealing of the relief passageways 124 by the arm 118e is maintained under the normal flow condition of FIGS. 4 and 6 by the higher supply pressure $P_1$ exerted on both the central portion 118a and the lower surface of diaphragm medial portion 118c in comparison to the lower pressure $P_2$ exerted on the upper surface of the washer 116 and the upper surface of the medial portion 118c. The higher pressure $P_1$ also opposes the downward biasing force of the spring 112 on the washer 116. The differential pressure on the medial portion 118c pulls the arm 118e upward across the relief passageways 124.

The upstream pressure $P_1$ is communicated from the upstream housing 64 to the relief valve diaphragm 118 through a flexible, control tube 126 which passes centrally through the upstream check valve disc 80 and has an intake filter 128 on the upstream surface of the disc 80. The tube 126 extends from the disc 80 through the cylinder 102, a central bore 129 in the valve cover 69, and the nipple 108*a*. The tube 126 then extends centrally through the washer 116 and diaphragm 118 where the lower end of the tube 126 is coupled to a rigid guide tube 130 having a lateral aperture 132. Alternatively the upstream pressure $P_1$ can be communicated to the diaphragm 118 via a tube external to the housing section 68. The aperture 132 provides a discharge opening from the tube 126 which is flexible so that it can move with either or both of the disc 80 and diaphragm 118. The tube 130 is reciprocable within the guide channel 134 formed centrally with the valve cover 120. The tube 130 guides the axial motion of the washer 116 and central diaphragm portion 118*a*. Under the normal flow conditions shown in FIGS. 4 and 6 the reduced pressure $P_2$ is communicated to the relief valve assembly 67 by the fluid which extends from the valve disc mouth 92*b* through the cylinder 102 (exterior to the tube 126), and through the bore 129 and nipple 108*a* to the upper surface of the washer 116 and the upper surface of the diaphragm medial portion 118*c*. The upstream pressure $P_1$ is measured through the testing valve 136 on the housing section 64 and the reduced pressure $P_2$ is measured through the testing valve 138 on the relief valve body 108. The downstream pressure $P_3$ as measured through the testing valve 140 reduced from pressure $P_2$ by the pressure drop of the flow through the second check valve between seat 78 and disc 92 as shown in FIG. 4.

Referring to FIG. 8, if the normal flow is shut off and the valve disc seal 94 fails to seal against the seat 78 to shut the second check valve drip tight, the pressure $P_2$ will rise in comparison to the supply pressure $P_1$ creating a decrease in their differential pressure, for example to less than 3 PSI. This reduction in the differential pressure enables the force of the spring 112 to displace the washer 116 and diaphragm central portion 118*a* downward, and the inner arm 118*d* follows this downward displacement. The downward displacement of the inner arm 118*d* causes the outer arm 118*e* to peel across and away from the openings of the drain passageways 124 as shown in the progressive phantom positions of the arms 118*d* and 118*e* in FIG. 7. Projecting from the valve cover 120 is an annular plastic stopper 140 which is aligned between the arms 118*d* and 118*e* to guide the displacement of and prevent an inversion of the U-shaped diaphragm portion 118*c*. Referring to FIG. 8, the backward or backflow of water from the discharge indicated by arrows C passes downward through the cylinder 102 and exits through the opened passageways 124 to ambient atmosphere.

Variations in the size and structural features of the cooperating parts and material used may occur to the skilled artisan without departing from the scope of the invention which is set forth in the claims hereto appended.

I CLAIM:

1. A backflow preventer apparatus for preventing backflow of fluid from a downstram conduit into an upstream conduit, comprising:

A. an upstream check valve;

B. a downstram check valve; and

C. a relief valve assembly for draining a zone between said respective check valves to prevent backflow through said upstream check valve, said assembly including:

1. valve seat means having at least one drain orifice communicating with ambient atmosphere; and
2. a flexible diaphragm having a U-shaped portion and a sealing portion, said sealing portion including one arm of said U-shaped portion and serving to close said orifice during normal fluid flow from said upstream check valve to said downstream check valve, said sealing portion being capable of peeling across and away from said orifice to enable fluid backflow therethrough from said downstream check valve to the atmosphere.

2. The apparatus of claim 1 wherein said diaphragm comprises an annular member including a medial portion having a U-shaped cross-section, wherein said sealing portion comprises one annular arm of said medial U-shaped portion.

3. The apparatus of claim 2 wherein said annular member includes a stationary outer peripheral portion engaging said seat means and a movable inner peripheral portion.

4. The apparatus of claim 3 wherein said inner peripheral portion defines a valve seat engageable with a valve disc to form said upstream check valve.

5. The apparatus of claim 1 further comprising a cylindrical housing containing said check valves, at least one of said check valves comprising a resilient, annular valve flap having a stationary outer periphery and a main body terminating at an inner annular periphery thereof, said main body being pivotal about said outer periphery and said inner periphery being pivotally engageable and disengageable with check valve seat means.

6. The apparatus of claim 5 wherein said check valve seat means comprises a circumferential outer surface of a stationary, dome-shaped hollow core fixed within said housing.

7. The apparatus of claim 6 wherein said core is connected to an annular anchoring ring, said outer periphery of said flap being clamped between said anchoring ring and the interior surface of said housing.

8. The apparatus of claim 6 wherein said core is connected to and radially inward of an annylar ring fitted to the interior surface of said hoursing, said ring and said core being connected by a plurality of rib members spaced in an annular pattern between said ring and said core thereby alternatively enabling said normal fluid flow and said backflow to pass between said rib members.

9. The apparatus of claim 8 wherein said rib members are integral with said anchoring ring and said core.

10. The apparatus of claim 8 wherein each of said ribs includes an edge located to support said flap when said inner periphery thereof is engaged with said core surface.

11. The apparatus of claim 7 wherein said flap defines a valve member of said downstream check valve, said core including a closed, downstream end, and said apparatus further comprising a coil spring centrally located within said core, one end of said spring being seated adjacent the closed end of said core and the other end of said spring being seated against a valve disc forming a spring-biased valve memer of said upstream check valve.

12. The apparatus of claim 11 wherein said diaphragm comprises an annular member including a stationary outer peripheral portion and a movalbe inner peripheral portion defining a valve seat engageable with said valve disc.

13. The apparatus of claim 1 wherein said diaphragm comprises a circular member including an annular, medial portion having a U-shaped cross-section, wherein said sealing portion comprises one annular arm of said medial, U-shaped portion.

14. The apparatus of claim 13 wherein said circular member includes a stationary outer peripheral portion engaging said seat means and a movable central portion.

15. The apparatus of claim 14 wherein said central portion is attached to a first surface of a movable, diaphragm support member having first and second opposing surfaces, said assembly further comprining first conduit means for communication of fluid pressure upstream from said upstream check valve to an exposed surface of said central portion, and biasing means for biasing said support member in opposition to said upstream fluid pressure upon said central portion.

16. The apparatus of claim 15 further comprising second conduit means for communication a second fluid pressure from said zone against said second surface of said support member in opposition to said upstream fluid pressure.

17. The apparatus of claim 16, wherein said U-shaped portion is oriented so tahtsaid upstream fluid pressure is exerted against a first surface of said arm and said U-shaped portion contiguous with said exposed surface of said central poriton, said second fluid pressure being exerted on at least a section of a second, opposing surface of said U-shaped portion in opposition to said upstream fluid pressure.

18. The apparatus of claim 16 wherein said upstream check valve and said downstream check valve comprise respective, concentric first and second annular valve seats, said valve seats being formed on a stationary, unitary valve seat member, said valves further comprising concentric, first and second independently operable valve discs engageable with said respective valve seats.

19. The apparatus of claim 18 wherein said first conduit means comprises a flexible tube passing through said second conduit means, said tube having a first end opening through an upstream surface of said first valve disc and a second end opening through said central portion.

20. The apparatus of claim 19 wherein said second conduit means comprises a cylinder passing through said second valve disc.

21. A backflow preventer apparatus for preventing bakcflow of fluid from a downstream conduit into an upstream conduit, comprising:

A. a Y-shaped valve body;

B. an upstream check valve in one arm of said valve body;

C. a downstram check valve in the other arm of said valve body; and

D. a relief valve assembly for draining a zone between said respective check valves to prevent backflow through said upstream check valve, said assembly being mounted in the base of said valve body and including:

1. valve seat means having at least one drain orifice communicating with ambient atmosphere; and
2. a flexible diaphragm having a U-shaped portion and a sealing portion, said sealing portion including one arm of said U-shaped portion and serving to close said orifice during normal fluid flow from said upstream check valve to said downstream check valve, said sealing portion being capable of peeling across and away from said orifice to enable fluid backflow therethrough from said downstream check valve to the atmosphere.

* * * * *

UNITED STATES PATENT AND TRADEMARK OFFICE

CERTIFICATE OF CORRECTION

PATENT NO. : 4,658,852

DATED : April 21, 1987

INVENTOR(S) : Zvi Weingarten

It is certified that error appears in the above-identified patent and that said Letters Patent are hereby corrected as shown below:

Column 5, lines 1 and 2, delete "vaZjzHuum" and insert --vacuum--;

Column 5, line 61, delete "dMzHMzHsengageable" and insert --disengageable--;

Column 9, claim 12, line 3, delete "movalbe" and insert --movable--;

Column 9, claim 15, line 17, delete "comprining" and insert --comprising--;

Column 9, claim 17, line 29, delete "tahtsaid" and insert --that said--;

Column 9, claim 17, line 32, delete "poriton" and insert --portion--; and

Column 10, claim 21, line 14, delete "bakcflow" and insert --backflow--.

Signed and Sealed this

First Day of September, 1987

*Attest:*

*Attesting Officer*

DONALD J. QUIGG

*Commissioner of Patents and Trademarks*